US012721381B1

(12) United States Patent
Macari et al.

(10) Patent No.: US 12,721,381 B1
(45) Date of Patent: Sep. 1, 2026

(54) INFANT SLEEP GARMENT WITH COMPRESSION ZONE

(71) Applicant: Halo Dream, Inc., New York, NY (US)

(72) Inventors: Jessica Macari, New York, NY (US); Bridget McGrath, New York, NY (US); Winny Zhang, New York, NY (US); Rachel Lindsey, New York, NY (US)

(73) Assignee: Halo Dream, Inc., New York, NY (US)

( * ) Notice: Subject to any disclaimer, the term of this patent is extended or adjusted under 35 U.S.C. 154(b) by 0 days.

(21) Appl. No.: 19/462,456

(22) Filed: Jan. 28, 2026

Related U.S. Application Data

(60) Provisional application No. 63/896,399, filed on Oct. 9, 2025.

(51) Int. Cl.
*A41B 13/06* (2006.01)

(52) U.S. Cl.
CPC ..... *A41B 13/06* (2013.01); *A41B 2400/00* (2013.01)

(58) Field of Classification Search
CPC ..... A41B 13/06; A47G 9/083
See application file for complete search history.

(56) References Cited

U.S. PATENT DOCUMENTS 949,164 A 2/1910 Tyrrell
7,246,392 B2 7/2007 Schmid et al.
8,347,432 B2 1/2013 Schmid et al.
9,179,711 B2 11/2015 Krawchuk
9,572,376 B2 2/2017 Gangan et al.
D866,122 S * 11/2019 Karp ..... D2/719
D873,528 S 1/2020 Parker
D883,613 S 5/2020 Damir et al.
D924,539 S 7/2021 Damir et al.
11,147,318 B2 10/2021 Hilton
11,178,925 B2 11/2021 Fischer
11,357,268 B2 6/2022 Krawchuk
11,395,517 B2 7/2022 Krawchuk
11,617,400 B2 4/2023 Gangan et al.
11,659,870 B2 5/2023 Damir et al.
11,812,795 B2 11/2023 Damir et al.
2013/0139290 A1* 6/2013 Barski ..... A41B 13/06 2/69.5
2013/0160181 A1* 6/2013 Mohr ..... A41B 13/06 2/69

(Continued)

FOREIGN PATENT DOCUMENTS

EP 3610750 2/2020
EP 3610750 A1 * 2/2020 ..... A41D 1/21

(Continued)

*Primary Examiner* — Eric J Kurilla
(74) *Attorney, Agent, or Firm* — Merchant and Gould P.C.

(57) ABSTRACT

An infant sleep garment configured to be worn by an infant and that is configured to apply compression to anterior regions of the infant, such as the chest and/or a portion of the abdomen, and corresponding posterior regions of the infant. The infant sleep garment includes arm pockets/compartments that allow the infant partial freedom of arm movement including to hands-raised, arms bent positions for finger/hand sucking, arms extended positions, and hands-lowered, arms bent positions.

8 Claims, 4 Drawing Sheets

(56) References Cited

U.S. PATENT DOCUMENTS

| | | | | |
|---|---|---|---|---|
| 2017/0295861 | A1 | 10/2017 | Trodden | |
| 2018/0332902 | A1* | 11/2018 | Damir | A41B 13/06 |
| 2019/0254355 | A1 | 8/2019 | Griffin | |
| 2019/0297954 | A1 | 10/2019 | Damir et al. | |
| 2021/0059317 | A1* | 3/2021 | Malcolm | A41B 13/06 |
| 2022/0039948 | A1 | 2/2022 | Lv et al. | |
| 2022/0117319 | A1* | 4/2022 | Peters | A41B 13/06 |
| 2022/0408851 | A1 | 12/2022 | Ghale-Gurung | |
| 2023/0125473 | A1 | 4/2023 | Krawchuk | |
| 2024/0206565 | A1 | 6/2024 | Krawchuk | |
| 2024/0225137 | A1 | 7/2024 | Gangan et al. | |

FOREIGN PATENT DOCUMENTS

| | | | | |
|---|---|---|---|---|
| KR | 102157467 B1 * | 9/2020 | | A41B 13/005 |
| WO | 2020051641 | 3/2020 | | |
| WO | WO-2020051641 A1 * | 3/2020 | | A41B 13/06 |

* cited by examiner

INFANT SLEEP GARMENT WITH COMPRESSION ZONE

PRIORITY

This application claims the benefit of U.S. provisional application Ser. No. 63/896,399 filed on Oct. 9, 2025, the entire contents of which are incorporated herein by reference.

FIELD

This disclosure describes an infant sleep garment that is configured to be worn by an infant. The infant sleep garment may also be referred to as a wearable blanket.

BACKGROUND

A number of infant sleep garments are known. Examples of known infant sleep garments include those described in U.S. Pat. Nos. 11,395,517, 11,357,268, 11,147,318, 9,179,711, and 7,246,392.

SUMMARY

An infant sleep garment (also referred to as a wearable blanket) is described herein. The infant sleep garment is configured to be worn by an infant, and in an embodiment, applies a compression to anterior regions of the infant, such as the chest and/or abdomen, and corresponding posterior regions of the infant. The infant sleep garment includes arm pockets or compartments that allow the infant partial freedom of arm movement including to hands-raised, arms bent positions for finger/hand sucking, arms extended positions, and hands-lowered, arms bent positions.

The infant sleep garment has a sack portion with right and left arm pockets/compartments. The sack portion forms an interior space, and a fastener, such as but not limited to a zipper, is provided on the sack portion that can be opened and closed to control access to the interior space. In an embodiment, the infant sleep garment completely encloses the infant except for the infant's head and neck which extends through a neck hole of the sleep garment.

The sack portion includes one or more compression zones that applies a compression force to an anterior region and a corresponding posterior region of the infant. The sack portion is formed primarily or entirely of a fabric material, and the compression zone(s) is formed of a material that may be formed of a material that is different from or the same as the material forming the majority of the sack portion. The material forming the compression zone may be any material that is suitable for applying a compression force described herein. For example, the material in the compression zone may include elastane, i.e. spandex, or other material that is capable of applying a compression force.

In addition, in an embodiment, the distal ends of the right and left arm pockets/compartments may be closed. In addition, the total distance between the distal ends of the arm pockets/compartments is chosen so as to allow the infant to extend his/her arms and push against the distal ends which helps to mitigate moro reflex.

In another embodiment, the sleep garment may not include a compression zone(s). Instead, the infant sleep garment may be used together with a separate swaddle element, with the swaddle element being used to provide restriction to the infant arms and/or compression to the infant. In still another embodiment, the sleep garment may be used by itself without a compression zone or separate swaddle element, in which case the sleep garment functions primarily as a wearable blanket.

In an embodiment, an infant sleep garment can include a sack portion that has a front, a rear, a left side, a right side, a top section, a bottom section, and an intermediate section between the top section and the bottom section, the sack portion forms an interior space. The sack portion can include a fastener that can be opened and closed to control access to the interior space. The bottom section is configured to surround an infant's hips and legs when the infant sleep garment is worn by an infant. In addition, a neck hole is at the top section through which an infant's neck extends when the sleep garment is worn, a left arm pocket/compartment at the left side of the sack portion that receives the infants left hand and some or all of the left arm, and a right arm pocket/compartment at the right side of the sack portion that receives the infants right hand and some or all of the right arm.

In an embodiment, the intermediate section may include a first compression zone on the front and rear of the sack portion, where the first compression zone is configured to apply a compression force to the infant when the infant sleep garment is worn by the infant, and the fastener extends through the first compression zone on the front or the rear of the sack portion. The first compression zone may be located to apply a compression force to some or all of the infant's chest and/or to some or all of the infant's abdomen, and corresponding regions on the anterior or back of the infant.

In another embodiment, the intermediate section may include a first compression zone on the front and rear of the sack portion and a second compression zone on the front and rear of the sack portion that is separate from the first compression zone. The first compression zone is configured to apply a compression force to the infant when the infant sleep garment is worn by the infant, and the second compression zone is between the first compression zone and the top section of the sack portion, and the second compression zone is configured to apply a compression force to the infant when the infant sleep garment is worn by the infant. The compression force applied by the second compression zone may be less than the compression force applied by the first compression zone. The second compression zone may form a transition between the top section of the sack portion and the first compression zone.

In another embodiment, an infant sleep garment can include a sack portion that has a front, a rear, a left side, a right side, a top, and a bottom. The sack portion forms an interior space, and a fastener on the sack portion that can be opened and closed controls access to the interior space. In addition, a neck hole is at the top, a left arm pocket/compartment is at the left side of the sack portion that receives the infants left hand and some or all of the left arm, and a right arm pocket/compartment is at the right side of the sack portion that receives the infants right hand and some or all of the right arm. The left arm pocket/compartment and the right arm pocket/compartment each have a closed distal end. The distal ends may be permanently closed, for example by sewing, or the distal ends may have closure mechanisms, such as zippers, one or more buttons, hook and loop fasteners, or the like to allow selective opening of the distal ends. A straight-line distance between the closed distal end of the left arm pocket/compartment and the closed distal end of the right arm pocket/compartment is such that the infant can push his/her hands against the distal ends when closed. This helps to mitigate moro reflex. For example, the straight-line distance may be at least 14.0 inches and less than or equal to about 20.0 inches. In another embodiment, the straight-line distance may be about 16.625 inches to about 17.125 inches.

The right and left arm pockets/compartments may also be integrally formed with the sack portion. An advantage of such a construction is that the sack portion does not have seams on the front or the back of the sack portion where the left arm pocket/compartment and the right arm pocket/compartment extend from the sack portion.

In another embodiment, an infant sleep garment can include a sack portion that has a front, a rear, a left side, a right side, a top, and a bottom. The sack portion forms an interior space, and the sack portion can include a fastener that can be opened and closed to control access to the interior space. In addition, a neck hole is at the top, a left arm pocket/compartment is at the left side of the sack portion that receives the infants left hand and some or all of the left arm, and a right arm pocket/compartment is at the right side of the sack portion that receives the infants right hand and some or all of the right arm. The left arm pocket/compartment and the right arm pocket/compartment each have a closed distal end. The distal ends may be permanently closed, for example by sewing, or the distal ends may have closure mechanisms, such as zippers, one or more buttons, hook and loop fasteners, or the like to allow selective openings of the distal ends. In addition, a straight-line distance between the closed distal end of the left arm pocket/compartment and the closed distal end of the right arm pocket/compartment is selected to allow the infant to push his/her hands against the distal ends when closed. For example, the straight-line distance may be at least 14.0 inches and less than or equal to about 20.0 inches. In another embodiment, the straight-line distance may be about 16.625 inches to about 17.125 inches. In addition, the sack portion includes a constant width section with a constant width between the top and the bottom. The fastener extends through the constant width section on the front or the rear of the sack portion, and the constant width is less than the straight-line distance. Further, the sack portion has a section with a maximum width located between the constant width section and the bottom. The maximum width is selected to allow the infant's legs and hips to freely move within a lower portion of the sack portion. In an embodiment, the maximum width is at least 14.0 inches but less than or equal to about 20.0 inches. In another embodiment the maximum width may be about 16.75 inches.

DRAWINGS

DETAILED DESCRIPTION

Figure 2:
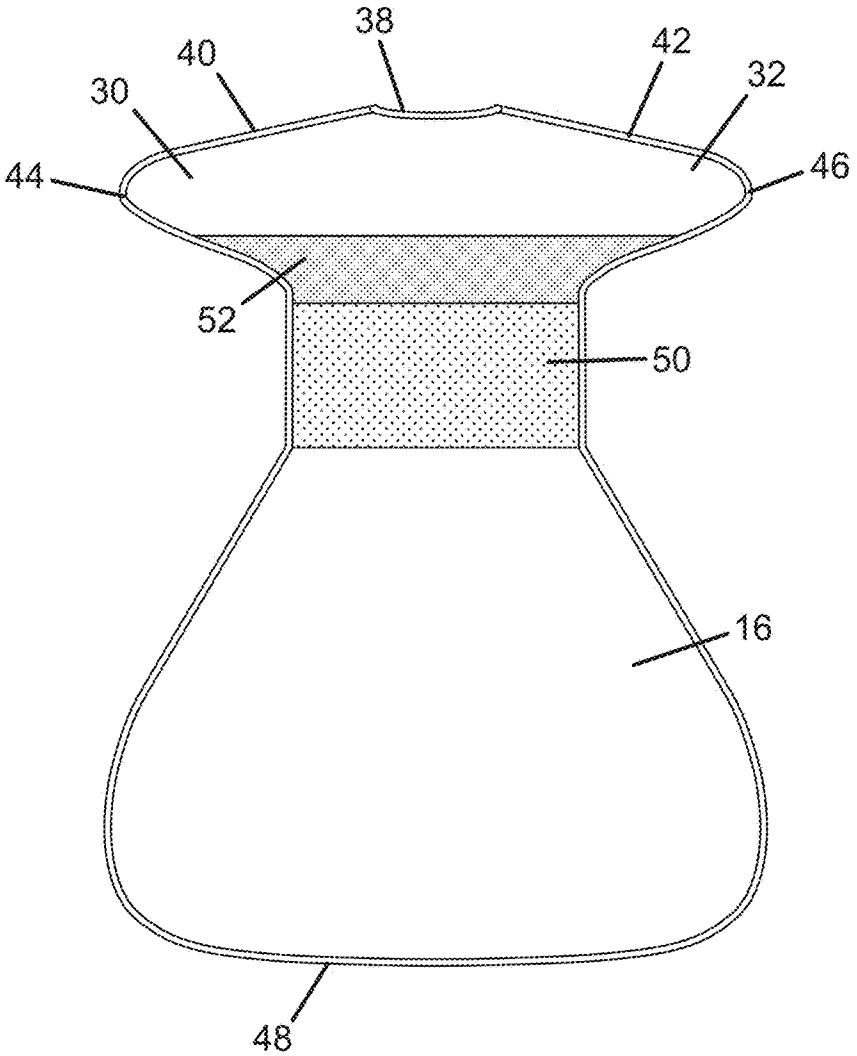
FIG. 2 is a view of the rear of the infant sleep garment of FIG. 1.

In an embodiment, an infant sleep garment is described that is configured to be worn by an infant, and when worn, applies a compression to anterior regions of the infant, such as the chest and/or abdomen, and corresponding posterior regions of the infant. The infant sleep garment includes arm pockets/compartments that allow the infant partial freedom of arm movement including to hands-raised, arms bent positions for finger/hand sucking, arms extended positions, and hands-lowered, arms bent positions. In this embodiment, the sleep garment may be provided with one compression zone or two or more compressions zones that are configured for applying the compression.

In another embodiment, the sleep garment may be formed without any compression zones but may have an overall configuration similar to the sleep garment having one or more compression zones. In this embodiment, the sleep garment may be referred to as a wearable blanket that is used primarily as a wearable blanket. If arm restriction and/or compression is desired, a separate swaddle element may be used. An example of a wearable blanket with a separate swaddling element is described in U.S. Pat. No. 7,246,392 the entire contents of which are incorporated herein by reference.

Referring to FIGS. 1-4, an example of an infant sleep garment 10 having one or more compression zones is depicted. In this embodiment, the sleep garment 10 is depicted as including a sack portion 12 that has a front or front surface 14, a rear or rear surface 16, a left side or left side edge 18, a right side or right side edge 20, a top section 22, a bottom section 24, and an intermediate section 26 between the top section 22 and the bottom section 24. In addition, the sack portion 12 includes a neck hole 28 through which an infant's neck extends when the sleep garment is worn (see FIG. 3), a left arm pocket/compartment 30 at the left side of the sack portion 12, and a right arm pocket/compartment 32 at the right side of the sack portion 12. The directional terms left, right, front, rear, top, bottom, etc. refers to directions from the viewpoint of an infant when wearing the sleep garment 10.

Figure 3:
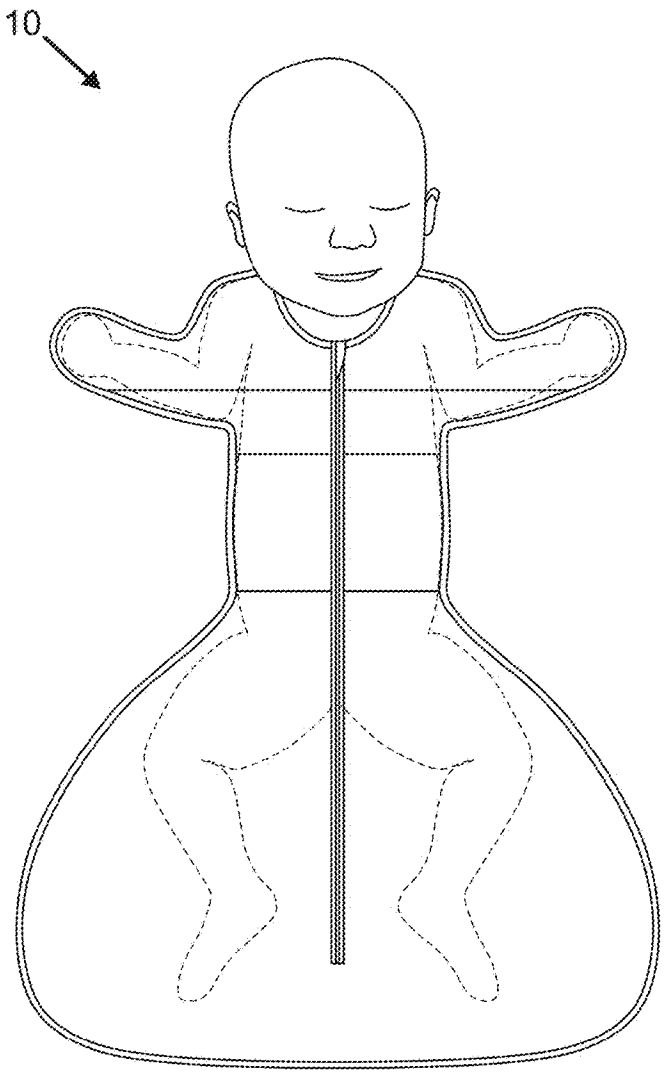
FIG. 3 is a view similar to FIG. 1 but depicting the infant sleep garment worn by an infant.

The sack portion 12 forms an interior space 34 that is large enough to receive the body of the infant therein except for the infant's head as depicted in FIG. 3. In use, the infant's neck extends through the neck hole 28 with the infant's head out of the sleep garment 10. A fastener 36 on the sack portion 12 is configured to be opened and closed to open and close the sleep garment 10 and control access to the interior space 34 for inserting the infant into and removing the infant from the sleep garment 10. The fastener 36 can have any configuration suitable for opening and closing the sleep garment 10. In the illustrated example, the fastener 36 extends from and intersects the neck hole 28, and extends down the sack portion 12 toward the bottom edge thereof. The fastener 36 is depicted as ending proximate a maximum width of the bottom section 24. In an embodiment, the fastener 36 can be a double-ended zipper with zipper pulls at the top end and at the bottom end of the fastener 36 to allow opening of the sack portion 12 from the top and from near the bottom. The fastener 36 is depicted as being on the front 14 of the sleep garment 10 and extending in a straight-line. However, the fastener 36 may be on the rear 16 or may be on one of the sides 18, 20, and the fastener 36 may be angled or curved. In addition, the fastener 36 is depicted as being located at the center of the front 14, midway between the sides 18, 20. However, the fastener 36 may be located offset from the center as well. The fastener 36 is not limited to a zipper and other fasteners can be used including, but not limited to, hook and loop fasteners, buttons, snaps, and others.

Figure 1:
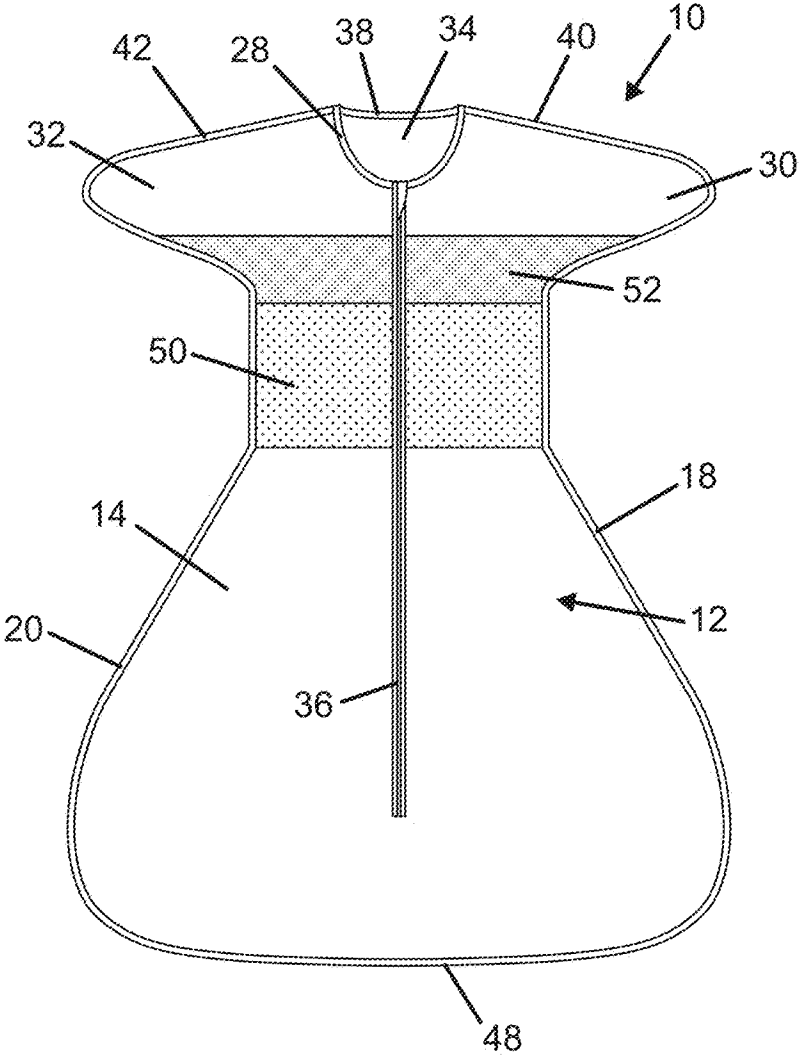
FIG. 1 is a view of the front of the infant sleep garment described herein.
Figure 4:
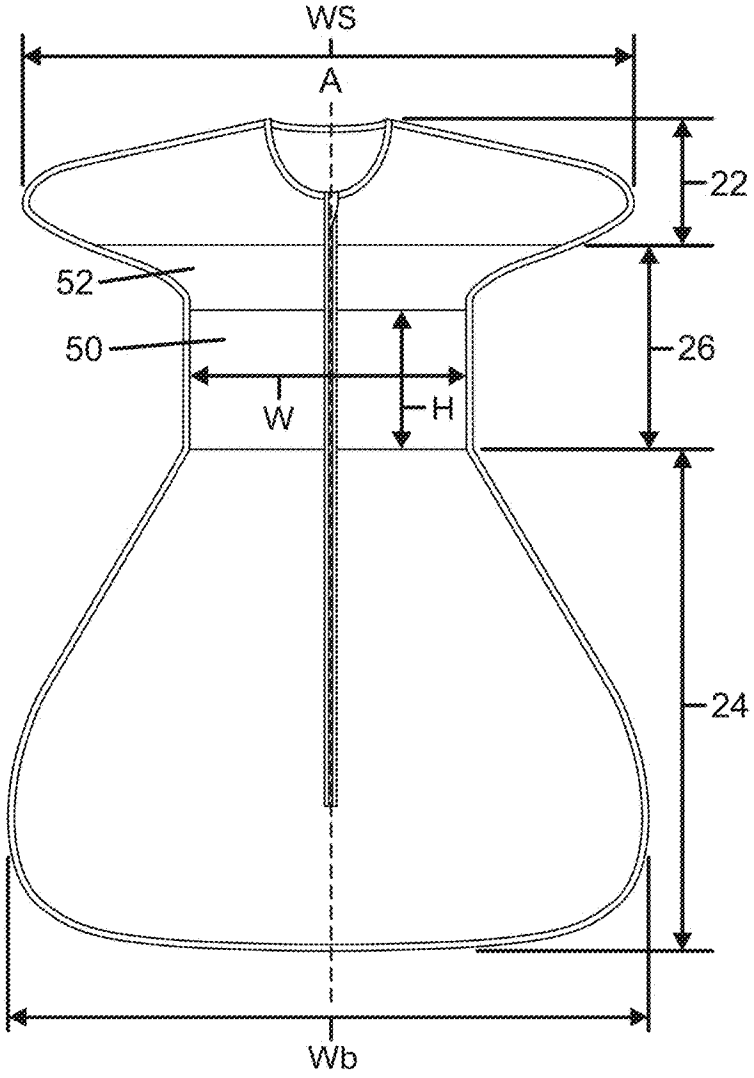
FIG. 4 is a view similar to FIG. 1 showing various sections and dimensions of the infant sleep garment.

Referring to FIGS. 1-2 and 4, the top section 22 defines the top of the sack portion 12. The top section 12 is configured to surround the infant's upper chest, shoulders and some or all of the left and right arm. The top section 22 includes the neck hole 28, and a portion or all of the left and right arm pockets/compartments 30, 32. The back edge 38 of the neck hole 28 transitions to left and right top edges 40, 42 that extend to distal ends 44, 46 of the pockets/compartments 30, 32. The top edges 40, 42 are angled downward from the back edge 38 and define, at least in part, upper edges of the pockets/compartments 30, 32. The fastener 36 extends into part of the top section 22. The edges 40, 42 are disposed below the back edge 38 and below what can be considered the shoulder line.

The distal ends 44, 46 may be permanently closed, for example by sewing. In another embodiment, the distal ends 44, 46 may have closure mechanisms, such as zippers, one or more buttons, hook and loop fasteners, or the like to allow selective opening of the distal ends 44, 46.

Referring to FIGS. 1-2 and 4, the bottom section 24 defines the bottom of the sack portion 12. The bottom section 24 is configured to surround an infant's hips and legs when the infant sleep garment is worn by an infant, and allows full movement, including flexion and abduction, of the infant's hip and legs. The bottom section 24 includes a bottom edge 48 that extends, for example continuously, from the left side 18 to the right side 20. The bottom edge 48 may be closed, for example permanently by sewing, or non-permanently for example by a zipper, one or more hook and loop fasteners, or other closures to allow the bottom edge 48 to be opened. The bottom section 24 includes part of the left side 18 and the right side 20 from where they intersect the bottom edge 48 up to the intermediate section 26. The fastener 36 extends into part of the bottom section 24 and may extend adjacent to a maximum width Wb (see FIG. 4) of the bottom section 24.

With continued reference to FIGS. 1-2 and 4, the intermediate section 26 defines the portion of the sack portion 12 between the top section 22 and the bottom section 24. The intermediate section 26 is configured to surround the infant's lower chest and at least a portion of the abdomen, and in this embodiment apply a compression force to the infant's chest and at least a portion of the abdomen. The intermediate section 26 includes part of the left side 18 and the right side 20 from where they extend from the bottom section 24 up to the top section 22. So in an embodiment, the sides 18, 20 may be considered to extend from the distal ends 44, 46 of the arm pockets/compartments 30, 32 to the bottom edge 48. The intermediate section 26 may also be considered to include bottom or lower parts of the arm pockets/compartments 30, 32. The fastener 36 extends into and through the intermediate section 26.

The intermediate section 26 is further depicted as including a first section 50 that has a constant width W and a constant height H. The constant width W and the constant height H of the first section 50 may be on the front 14, on the rear 16, or on both the front 14 and the rear 16. The intermediate section 26 is further depicted as including a second section 52. The second section 52 may be contiguous with and extend upwardly from the first section 50. In another embodiment, there may be a gap between the first section 50 and the second section 52. In another embodiment, the first section 50 may be present but the second section 52 may not be present, or the first section 50 may not be present but the second section 52 may be present. The second section 52 may have a continuous width portion where it extends from the first section 50, with the width of the second section increasing as the second section 52 extends into the arm pockets/compartments 30, 32.

The first section 50 is configured to form a first compression zone on the front 14 and rear 16 of the sack portion 12 to apply a first compression force to the infant, for example to the lower chest and at least a portion of the abdomen, when the sleep garment is worn by the infant. The first compression zone extends from the left side 18 to the right side 20 of the sack portion 12 on the front 14 and/or on the rear 16. The second section 52 is configured to form a second compression zone on the front 14 and rear 16 of the sack portion 12 to apply a second compression force to the infant, for example to the chest or upper abdomen, when the infant sleep garment is worn by the infant. The second compression zone also extends from the left side 18 to the right side 20 of the sack portion 12 on the front 14 and/or on the rear 16, with a portion of the second compression zone extending onto the left arm pocket/compartment 30 and onto the right arm pocket/compartment 32. The first compression force applied by the first compression zone may be the same as the second compression force applied by the second compression zone. In another embodiment, the first compression force applied by the first compression zone may be greater than or less than the second compression force applied by the second compression zone. The second section 52 forms a transition between the top section 22 and the first section 50.

The sack portion 12 can be formed of any fabric material (s). For example, the top section 22 and the bottom section 24 may be formed from one or more of cotton, cotton blends, fleece, bamboo fabric, microfiber, polyester, or other fiber types, formed from non-fibrous material(s), or formed from a combination of fibrous and non-fibrous materials. The intermediate section 26 may be formed of a material(s) that differs from the material used to form the top section 22 and the bottom section 24 and that is suitable for forming the compression zones and that is suitable for applying a compression force to the infant. For example, the first and second sections 50, 52 may be formed from material used to form the sections 22, 24 together with a functional material included therein including, but not limited to, elastane, i.e. spandex, that allows the sections 50, 52 to provide compression force.

Referring to FIG. 4, the straight-line distance between the distal ends 44, 46 of the pockets/compartments 30, 32 that is perpendicular to a vertical axis A of the sleep garment 10 may be referred to as the arm span or wing-span WS of the sleep garment 10. The maximum width of the bottom section 24 is indicated as Wb. The constant width of the first section 50 is indicated as W and the constant height of the first section 50 is indicated as H.

The arm span WS is less than the arm span of an infant. This permits the infant to push his/her hands against the distal ends 44, 46 when the ends 44, 46 are closed. For example, in one embodiment, the arm span WS may be at least about 15.0 inches and less than or equal to about 20.0 inches. In another embodiment, the arm span WS may be about 16.625 inches to about 17.125 inches. In another embodiment, the arm span WS may be about 14.625 inches to about 18.625 inches. Other dimensions are possible.

In addition, the constant width W is less than arm span WS. In an embodiment, the constant width W may be from about 5.75 inches to about 8 inches, or from about 7.0 inches to about 8.0 inches, or from about 7.0 inches to about 7.5 inches, or about 7.5 inches to about 8.0 inches, or about 7.25 inches, or about 7.75 inches. The constant height H may be about 3.75 inches, ±5%, or ±15%, or ±25%. The maximum height of the second section 52 adjacent to the fastener may be about 1.75 inches, ±5%, or ±15%, or ±25%. Other dimensions are possible.

In an embodiment, the maximum width Wb may be at least about 15.0 inches but less than or equal to about 20.0 inches. In another embodiment the maximum width Wb may be about 16.5 inches to about 17.0 inches, or about 16.75 inches. Other dimensions are possible.

The sleep garment may have a total height (i.e. from the back edge 38 to the bottom edge 48 along the vertical axis A) of about 21.25 inches to about 21.75 inches, or about 21.5 inches. Other dimensions of the sleep garment are possible.

The sections 22, 24, 50, 52 of the garment may be formed from non-functional fabric(s), or a combination of functional fabric(s) and non-functional fabric(s). The non-functional fabric(s) may be one or more yarn(s), for example cotton, nylon, or other yarn(s). The functional fabric(s) may be one or more yarn(s), for example Spandex or other elastic synthetic fibers.

The following Tables 1 and 2 are example constructions of sleep garments for preemies (i.e. a baby born before 37 weeks of gestation), newborn (0 to 3 months of age), and small (3-6 months of age).

TABLE 1

| Section | Preemie Section Height H (inches ±5% or ±10% or ±15% or ±25%) | Newborn Section Height H (inches ±5% or ±10% or ±15% or ±25%) | Small Section Height H (inches ±5% or ±10% or ±15% or ±25%) |
|---|---|---|---|
| Top section 22 | 2.95 | 3.625 | 4.29 |
| Second section 52 | 1.42 | 1.75 | 2.08 |
| First section 50 | 3.05 | 3.75 | 4.44 |
| Bottom section 24 | 10.17 | 12.5 | 14.82 |
| Total | 17.5 | 21.5 | 25.5 |

TABLE 2

| Point of Measure | Tolerance (inches) | Preemie (inches) | Newborn (inches) | Small (inches) |
|---|---|---|---|---|
| Width W | ±0.25 | 5.75 | 7.25 | 8.0 |
| Arm span WS | ±0.25 | 14.625 | 16.625 | 18.625 |
| Max width Wb | ±0.25 | 13 | 16.75 | 16.75 |

Figure 6:
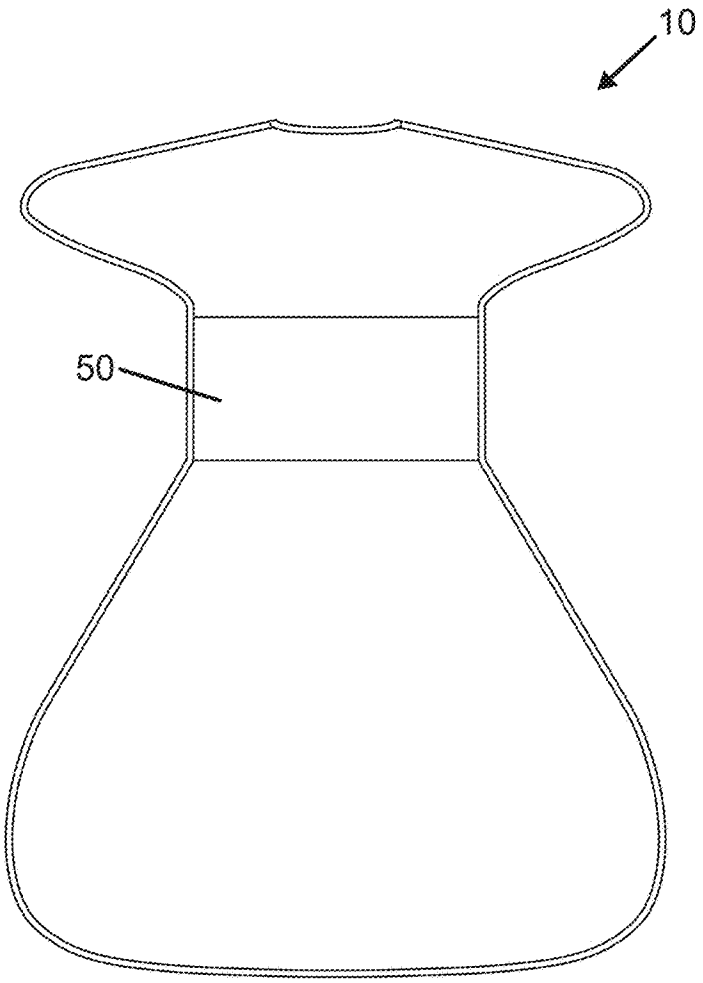
FIG. 6 is a view of the rear of the infant sleep garment of FIG. 5.
Figure 5:
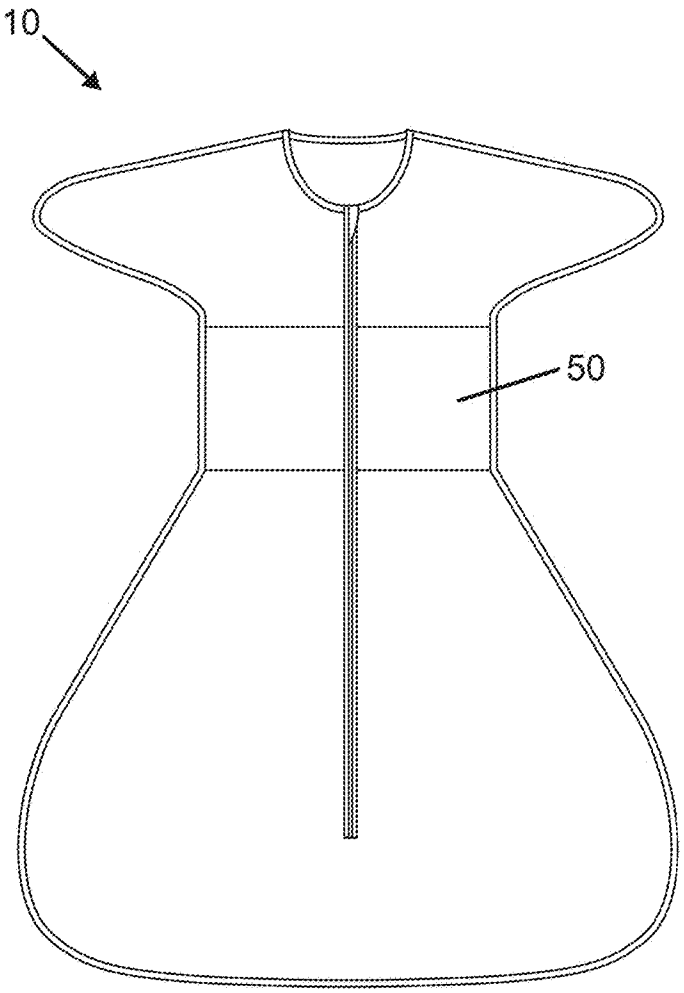
FIG. 5 is a view of the front of another embodiment of an infant sleep garment described herein.

FIGS. 5 and 6 illustrate another embodiment of the sleep garment 10. In FIGS. 5-6, elements that are similar to or identical to elements in the sleep garment of FIGS. 1-4 are referenced using the same reference numeral. The sleep garment 10 in FIGS. 5-6 includes a single compression zone, for example the compression zone formed by the first section 50. In another embodiment, the single compression zone may be formed by the second section 52. The sleep garment 10 in FIGS. 5-6 may have a construction that is otherwise identical to the sleep garment 10 described in FIGS. 1-4.

Figure 8:
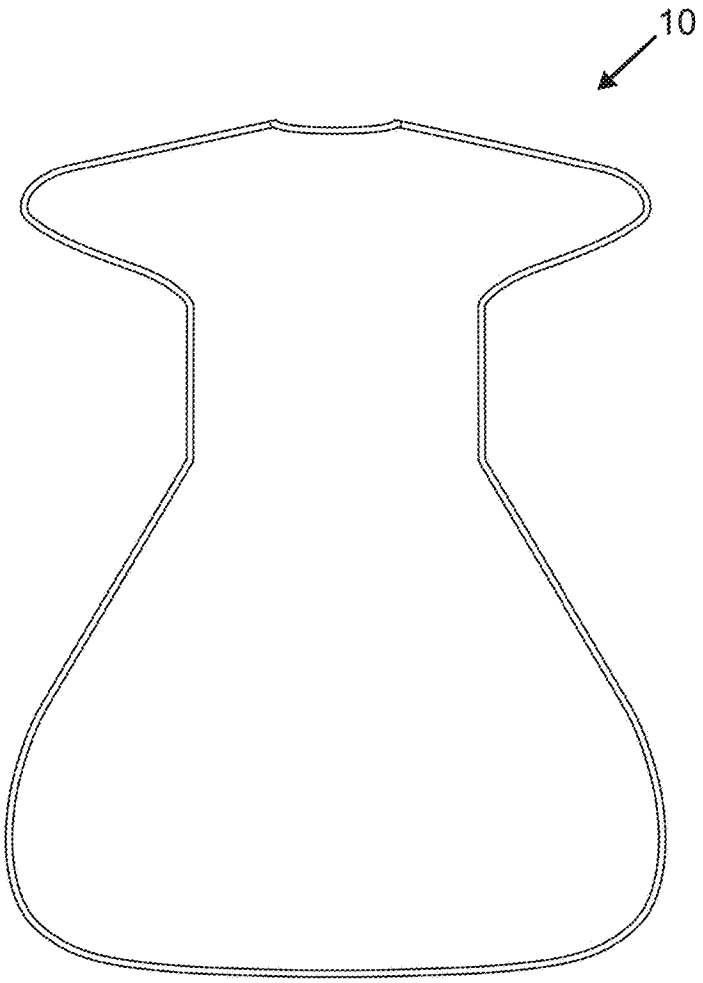
FIG. 8 is a view of the rear of the infant sleep garment of FIG. 7.
Figure 7:
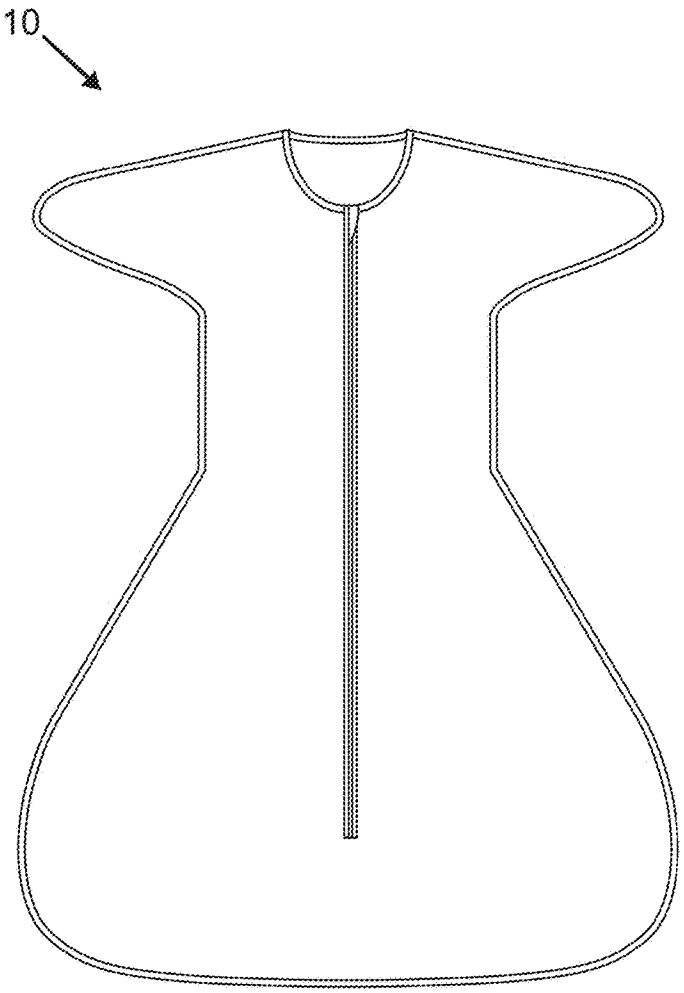
FIG. 7 is a view of the front of another embodiment of an infant sleep garment described herein.

FIGS. 7 and 8 illustrate another embodiment of the sleep garment 10. In FIGS. 7-8, elements that are similar to or identical to elements in the sleep garment of FIGS. 1-4 are referenced using the same reference numeral. The sleep garment 10 in FIGS. 7-8 includes no compression zones, such as the zones 50, 52. Instead, the sleep garment 10 may be used together with a separate element (not shown) that provides compression, for example as described in U.S. Pat. No. 7,246,392 the entire contents of which are incorporated herein by reference. In another embodiment, the sleep garment 10 of FIGS. 7-8 may be used by itself without a compression zone or a separate element, in which case the sleep garment 10 functions primarily as a wearable blanket. The sleep garment 10 in FIGS. 7-8 may have a construction that is otherwise identical to the sleep garment 10 described in FIGS. 1-4.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. An infant sleep garment, comprising:

a sack portion that has a front, a rear, a left side, a right side, a top section, a bottom section, and an intermediate section between the top section and the bottom section, the sack portion forms an interior space;

a fastener on the sack portion that can be opened and closed to control access to the interior space;

the bottom section is configured to surround an infant's hips and legs when the infant sleep garment is worn by an infant;

a neck hole at the top section;

a left arm pocket at the left side of the sack portion;

a right arm pocket at the right side of the sack portion;

the intermediate section includes a first compression zone on the front and rear of the sack portion, the first compression zone is configured to apply a compression force to the infant when the infant sleep garment is worn by the infant, and the fastener extends through the first compression zone on the front or the rear of the sack portion;

the intermediate section includes a second compression zone on the front and rear of the sack portion, the second compression zone is configured to apply a compression force to the infant when the infant sleep garment is worn by the infant, and the fastener extends through the second compression zone on the front or the rear of the sack portion; and the compression force applied by the first compression zone is greater than or less than the compression force applied by the second compression zone.

2. The infant sleep garment of claim 1, wherein the second compression zone extends onto the left arm pocket and the right arm pocket.

3. The infant sleep garment of claim 1, wherein the first compression zone extends from the left side to the right side of the sack portion on the front and/or on the rear.

4. The infant sleep garment of claim 3, wherein the first compression zone has a constant width, and the first compression zone has a constant height on the front and/or on the rear.

5. An infant sleep garment, comprising:

a sack portion that has a front, a rear, a left side, a right side, a top section, a bottom section, and an intermediate section between the top section and the bottom section, the sack portion forms an interior space;

a fastener on the sack portion that can be opened and closed to control access to the interior space;

the bottom section is configured to surround an infant's hips and legs when the infant sleep garment is worn by an infant;

a neck hole at the top section;

a left arm pocket at the left side of the sack portion;

a right arm pocket at the right side of the sack portion;

the intermediate section includes:

a first compression zone on the front and rear of the sack portion, the first compression zone is configured to apply a compression force to the infant when the infant sleep garment is worn by the infant; and a second compression zone on the front and rear of the sack portion that is separate from the first compression zone, the second compression zone is between the first compression zone and the top section, and the second compression zone is configured to apply a compression force to the infant when the infant sleep garment is worn by the infant;

the compression force applied by the first compression zone is greater than or less than the compression force applied by the second compression zone.

6. The infant sleep garment of claim 5, wherein the second compression zone extends onto the left arm pocket and the right arm pocket.

7. The infant sleep garment of claim 5, wherein the first compression zone extends from the left side to the right side of the sack portion on the front and/or on the rear.

8. The infant sleep garment of claim 7, wherein the first compression zone has a constant width, and the first compression zone has a constant height on the front and/or on the rear.

* * * * *